US007938177B1

(12) United States Patent
Wiggins et al.

(10) Patent No.: US 7,938,177 B1
(45) Date of Patent: May 10, 2011

(54) CIRCULATING SUB TOOL FOR DISPENSING AND CIRCULATING FLUID IN A WELL BORE

(75) Inventors: Richard Jay Wiggins, Runaway Bay, TX (US); Truman Randall Davis, Abilene, TX (US)

(73) Assignee: Express Energy Services Operating, LP, Bridgeport, TX (US)

( * ) Notice: Subject to any disclaimer, the term of this patent is extended or adjusted under 35 U.S.C. 154(b) by 42 days.

(21) Appl. No.: 12/355,989

(22) Filed: Jan. 19, 2009

(51) Int. Cl.
*E21B 17/06* (2006.01)
*F16L 25/06* (2006.01)

(52) U.S. Cl. ..... 166/242.6; 285/333; 285/922

(58) Field of Classification Search ..... 166/242.6; 285/333, 922
See application file for complete search history.

(56) References Cited

U.S. PATENT DOCUMENTS

| | | | | |
|---|---|---|---|---|
| 1,961,763 | A * | 6/1934 | Hinderliter | 277/328 |
| 2,500,276 | A * | 3/1950 | Church | 285/2 |
| 2,565,547 | A * | 8/1951 | Collins | 285/3 |
| 4,129,308 | A * | 12/1978 | Hutchison | 277/335 |
| 4,658,915 | A * | 4/1987 | Goris et al. | 175/57 |
| 5,392,862 | A | 2/1995 | Swearingen | |
| 7,048,079 | B1 | 5/2006 | Parker | |

* cited by examiner

*Primary Examiner* — Kenneth Thompson
(74) *Attorney, Agent, or Firm* — Buskop Law Group, PC; Wendy Buskop

(57) ABSTRACT

A circulator sub tool for dispensing and circulating fluid in a well bore having a threaded packer sub with a quick coupler body, and wherein diameters for each annulus of the quick coupler body and the sub body are substantially identical enhancing laminar flow through the threaded packer sub.

18 Claims, 6 Drawing Sheets

CIRCULATING SUB TOOL FOR DISPENSING AND CIRCULATING FLUID IN A WELL BORE

FIELD

The present embodiments generally relate to equipment used in the drilling and completion of subterranean wells, and can be used for filling and circulating of the drilling fluids in a casing string as well as pumping cement into the casing to set the casing within a wellbore. The embodiments further relate to apparatus for use in well bores and circulating subs used during downhole drilling operations, but are not limited to.

BACKGROUND

A need exists for an circulation sub including a threaded packer sub and a quick coupler body for circulating and dispensing fluid in a well bore that is a efficient, easy to maintain and reliable.

It is known in the art to utilize the pressure of fluid pumped through a work string in a well bore to control a hydraulically activated tool in the well bore.

The hydraulic pressure to operate these tools is typically supplied from the surface of the well bore by pumps. Due to the distances of travel to the location it can be difficult to control the operation of tools in the well bore to provide a constant pressure to give a uniform control.

It has been recognized that being able to control the flow of hydraulic fluid adjacent a hydraulically operated downhole tool would be advantageous. U.S. Pat. No. 5,392,862 describes a drilling mud flow control sub that provides the necessary fluid flow and pressure to activate an expanding remedial tool such as an underreamer, section mill or other cutting tool. The sub consists of a cylindrical sub assembly housing forming a first upstream end and a second downstream end. The housing is threadably connected between a drill string at its first upstream end and a tool at its downstream end. Intermediate the upstream and downstream ends is located a drop ball seat so that insertion of a drop ball will prevent hydraulic fluid flow to the tool. A rupture disc is affixed to a hole formed in the control sub wall normal to the sub axis, above the drop ball seat, so that when obstructed fluid is shunted from the sub.

This flow control sub has reliability problems. A need has exists for a circulating sub that is reliable, easy to use, and easy to maintain.

It is a yet further object of at least one embodiment of the present invention to provide a control sub for use with a hydraulically operated downhole tool which allows selective control of fluid circulation when the tool is run in or tripped from the well.

It is a still further object of the present invention to provide a method of accurately and reliably controlling hydraulic pressure to a hydraulically operated downhole tool in a well bore.

The present embodiments meet these needs.

BRIEF DESCRIPTION OF THE DRAWINGS

The detailed description will be better understood in conjunction with the accompanying drawings as follows.

Figure 1:
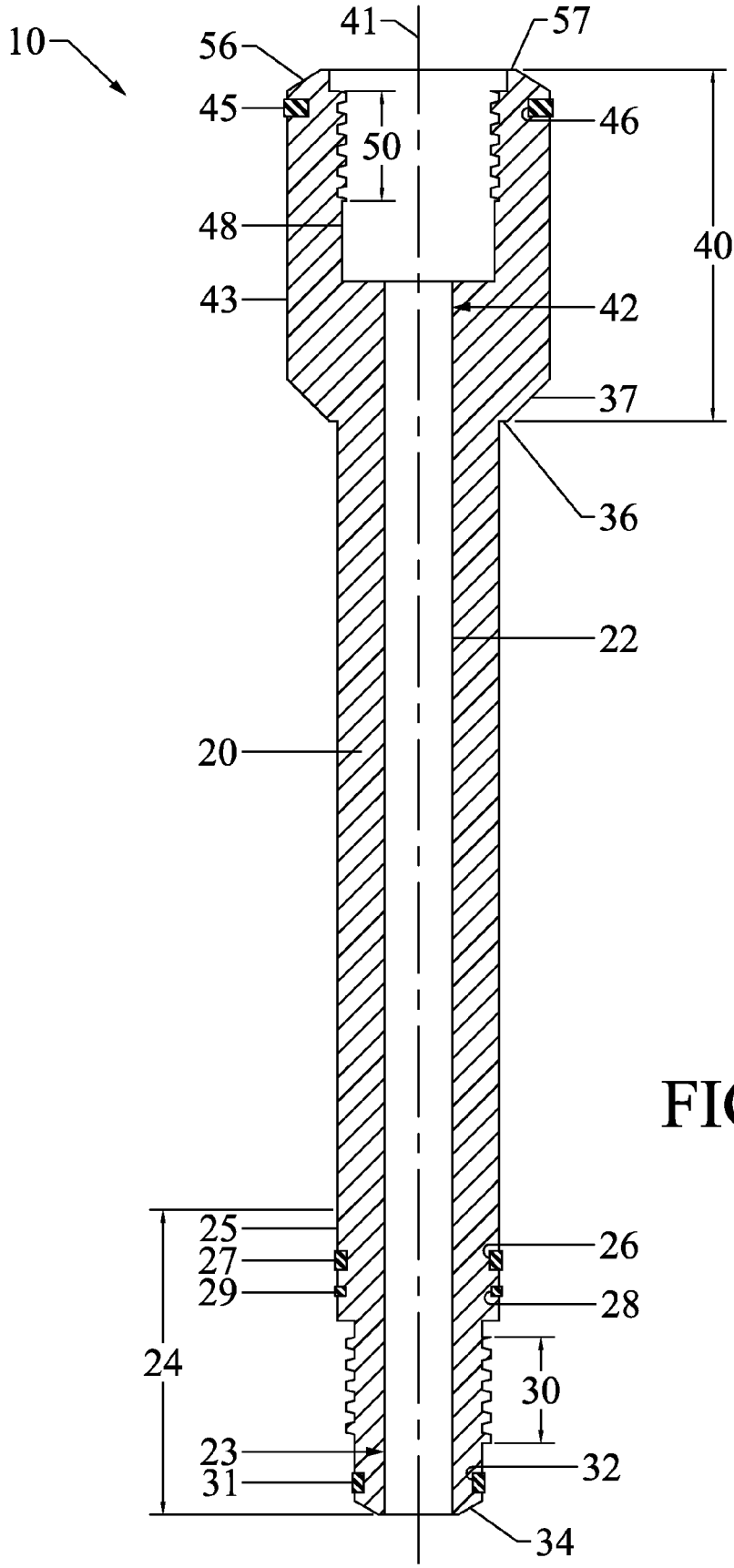
FIG. 1 illustrates a cross sectional side view of the packer sub in accordance with certain embodiments of the present invention.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a circulator sub tool for dispensing and circulating fluid in a well bore. The circulator sub tool principally contains a threaded packer sub coupled with a quick coupler body.

The embodiments further relates to a tool for use in well bores, such as to circulate drilling fluids and drilling muds used during down hole drilling, completion and work over operations. The embodiments are not only limited to these examples.

A benefit of the invention is that the two part assembly is quick easy and reliable to operate.

With the pin embodiment of the invention, secondary seals are created for a more secure sealing environment for the tool, preventing fluid from flowing to the environment and polluting the surrounding soil. The redundant seal provides increased for an operator or user, as well as the sealing of the well bore fluids from the rest of the drill string.

The threaded packer sub can have a sub body integrally connected to an upper end and a lower end.

The lower end can have a lower end bore and an exterior, where the exterior can have a locking groove. The bore can have a first inner seal, a threaded section, a second inner seal, and an inner threaded shoulder.

The upper end can have an upper end axis along which is formed an upper end bore. The upper end can also have a sub shoulder in communication with a centering guide face. The sub shoulder can provide a sealing engagement with the centering guide face.

The exterior of the upper end can have an upper locking groove. On the upper end, the locking groove can be on the interior, and further the upper end can also have an upper first inner seal area, an upper threaded section, and an upper locking retainer bore disposed through the upper end at an angle between about 60 degrees to about 90 degrees from the upper end axis. This upper locking retainer bore can be adapted for receiving an upper locking pin. The upper locking retainer bore can give an operator the ability for a quick change out of parts and tools, and eliminates an accidental back off from the connector, such as from the sub body or from another piece of equipment securing to the upper end.

The quick coupler body can be used for threadably engaging the sub body and can contain a quick coupler bore and a quick coupler axis and a quick coupler exterior. A lower threaded adapter can be formed around the quick coupler bore and can have two or more lower threaded retainer bores.

The quick coupler body can have a first quick coupler face formed adjacent to the lower threaded adapter around the bore. A quick coupler lower seal can be disposed around the quick coupler bore above the first quick coupler face. Additionally, a second seal area can be formed around the quick coupler bore. This redundant sealing system provides a higher level of safety than single seal systems.

An upper threaded area can be formed around the quick coupler bore. A third seal area can be formed around the quick coupler bore adjacent the upper threaded area. A quick coupler locking groove can be formed in the quick coupler exterior. A quick coupler retainer bore can be disposed between about 60 degrees to about 90 degrees from the quick coupler axis and adapted for receiving a quick coupler retainer pin. The pin and retainer bore combination makes it easier to remove the coupler from the upper end of the sub body, compared with other tools of different construction.

A quick coupler guide face can be formed in the quick coupler exterior for aligning components of the tool together.

A quick coupler shoulder can be formed in the quick coupler exterior. Diameters for each bore of the quick coupler body and the sub body are substantially identical enhancing laminar flow of drilling or completion fluids through the threaded packer sub.

In an embodiment, the quick coupler can have a tapered outer body guide face formed in the quick coupler exterior between the quick coupler lower seal and a quick coupler lower face. The outer body guide face can be tapered to reduce hang up of the tool on other components in the well bore during installation or removal of the tool.

In another embodiment, the inner threaded shoulder creates a metal to metal seal with the quick coupler body.

In still another embodiment, the locking grooves support seals can be thermoplastic, elastomeric, or interlocking composite seals.

In an embodiment, the quick coupler body can be carbon steel or special alloys, or they can be stainless steel that is non-deforming in a harsh environment.

A gauge ring can be disposed over the sub body and positioned adjacent the quick coupler shoulder.

A packer cup can surround the sub body in proximity to the gauge ring.

A packer thimble can surround the sub body adjacent the packer cup for supporting pressure up to about 5000 psi.

Figure 3:
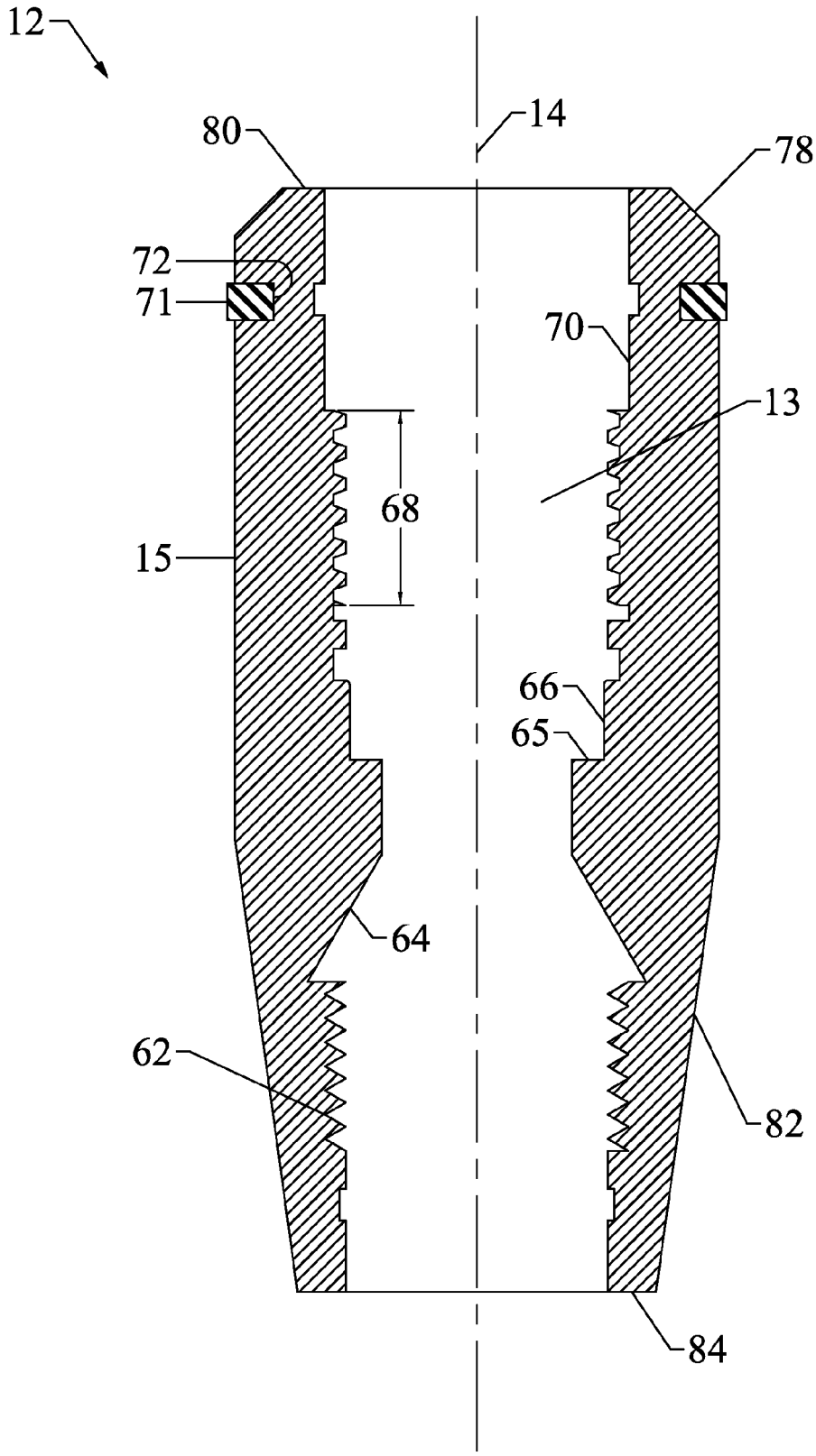
FIG. 3 illustrates a cross sectional side view of the quick coupler body in accordance with certain embodiments of the present invention.

Turning now to the Figures, FIG. 1 shows a threaded packer sub 10 connected to a quick coupler body 12 that is provided in more detail in FIG. 3.

The threaded packer sub has a sub body 20, with a sub body bore 22 and a lower end 24, and a sub body upper end 40.

The lower end has a lower end bore 23 and a lower end exterior 25. On the lower end exterior is lower end locking groove 26 with a seal 27.

A first inner seal 29 within a first groove 28 and a second inner seal 31 within a second groove 32 are formed on the lower end exterior 25. A threaded section between about 1 inch to about 3 inches is located between the first and second inner seals. The inner seals represented here can be rubber 0-rings.

An inner shoulder 34 can also be in the lower end 24 at the outer most portion of the lower end. The inner shoulder 34 and second inner seal 31 can be used for engaging the quick coupler body 12.

The sub body upper end 40 has a upper end sub shoulder 36 machined at an angle of about 90 degrees from an upper end axis 41.

Adjacent the upper end sub shoulder 36 is a centering guide face 37. The upper end sub shoulder is at an angle from about 30 degrees to about 60 degrees from the upper end axis 41.

The sub body upper end 40 has an upper end bore 42 and an upper end exterior 43 surrounding the upper end bore.

The sub body upper end 40 further has an upper locking groove 46 for receiving an o-ring or other sealing device 45.

The sub body upper end can have an upper first inner seal area 48, an upper threaded section 50 adjacent the upper first inner seal area 48. The upper threaded section 50 can between about 1 inch to about 3 inches long and can have right or left handed thread types pending customer well bore specifications.

FIG. 1 also shows the upper guide face 56 which is on the upper end exterior 43. The upper guide face 56 is formed at an angle between about 30 degrees to about 60 degrees from the upper end axis 41. An upper shoulder 57 is at the end of the sub body upper end 40 opposite the sub body 20.

Figure 2:
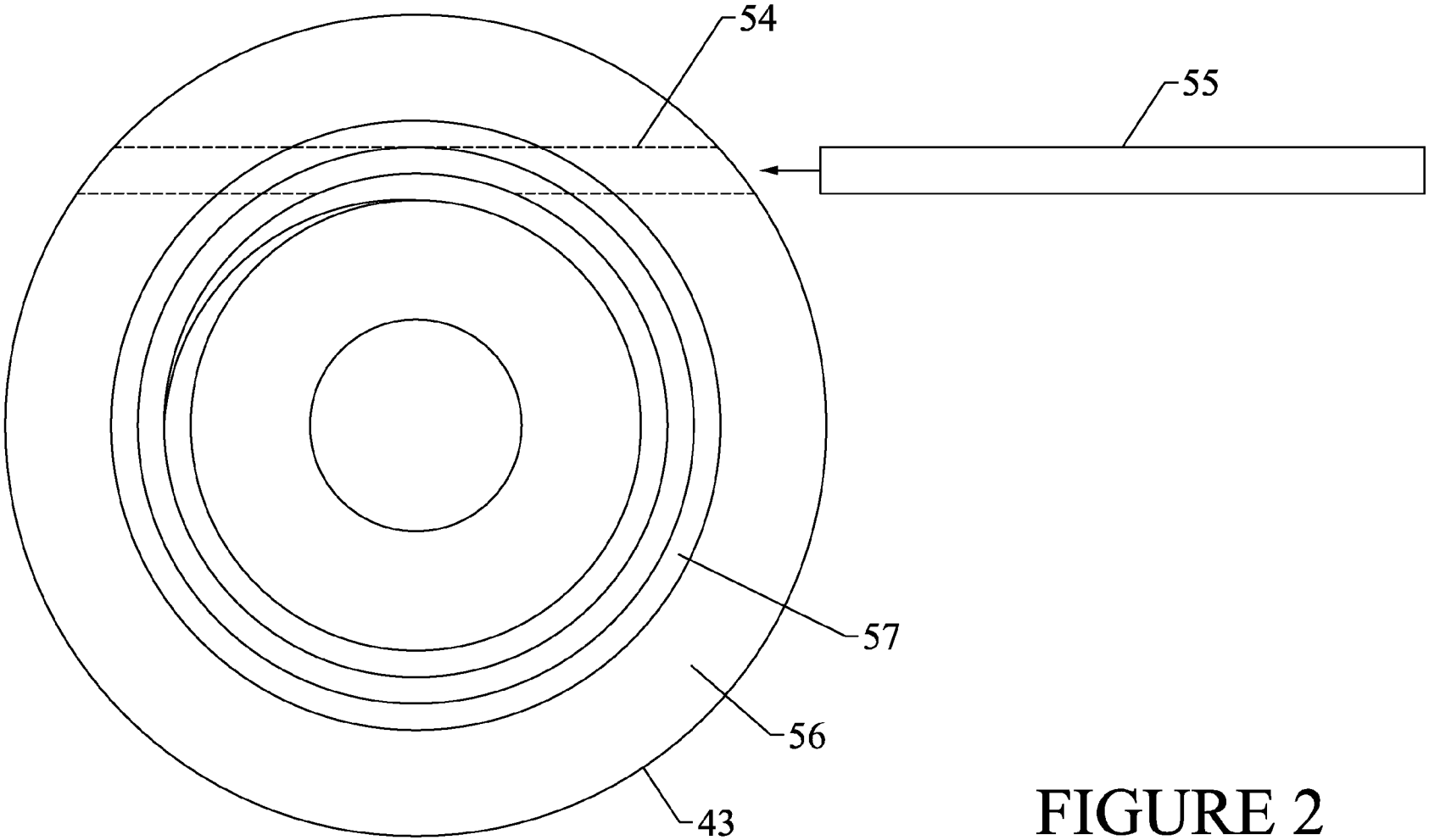
FIG. 2 illustrates a top view of the packer sub in accordance with certain embodiments of the present invention.

FIG. 2 is a top view of the upper end, depicting the upper end exterior 43 with an upper locking retainer bore 54 adapted for receiving an upper locking pin 55.

The upper locking retainer bore can have a diameter between about 0.2 inches to about 0.5 inches and the upper locking pin can be made from solid steel, or can be a hollow pin made from steel or a similar non-deforming material.

FIG. 3 shows a quick coupler body 12 with a quick coupler bore 13 and a quick coupler axis 14 and a quick coupler exterior 15.

The quick coupler 12 can have a lower threaded adapter 62 for engaging hose assemblies, or extending or engaging other well bore components needing fluid circulation.

Figure 4:
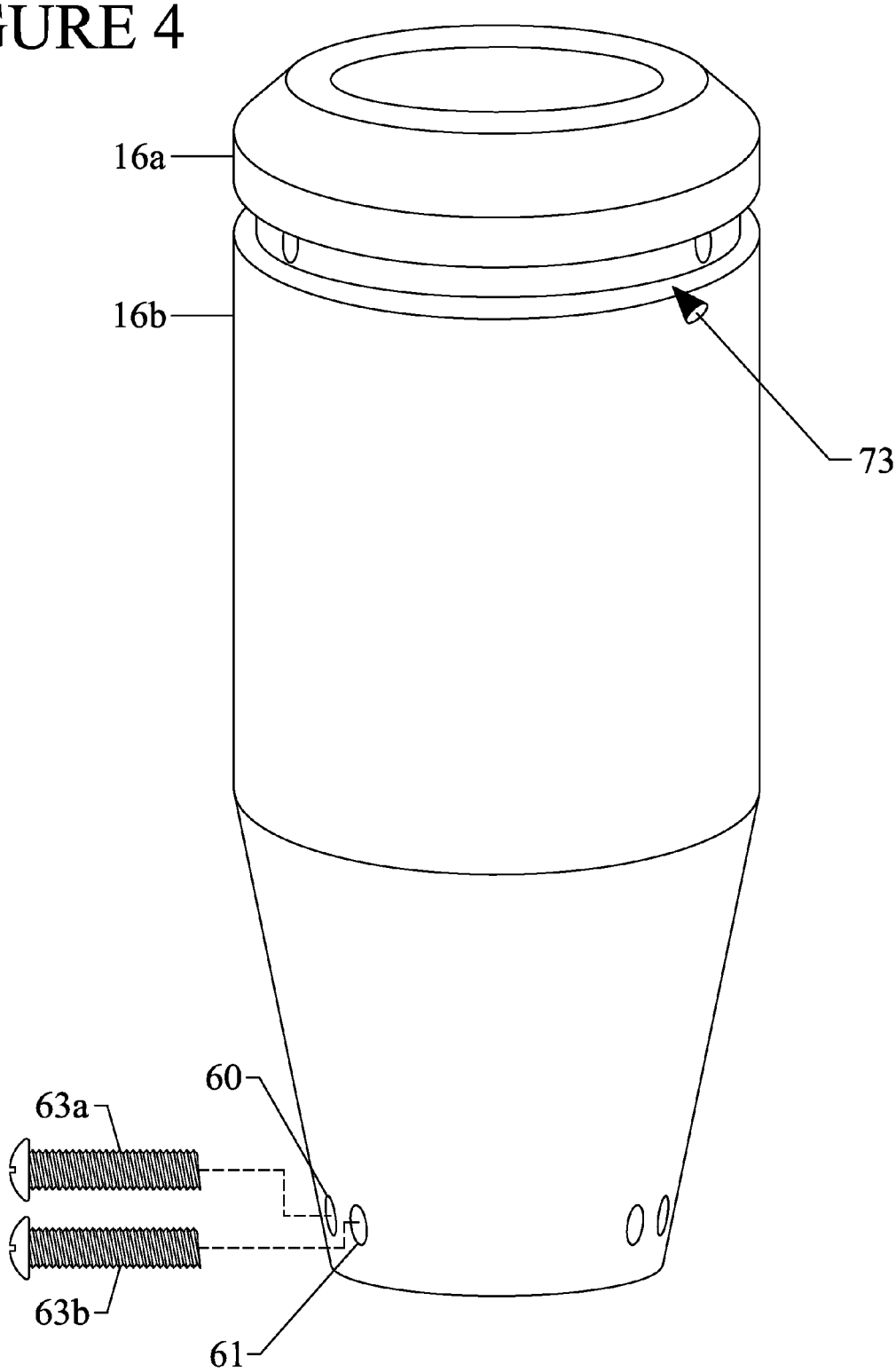
FIG. 4 illustrates a cross sectional top view of the quick coupler body in accordance with certain embodiments of the present invention.

FIG. 4 shows an isometric view of the quick coupler with at least a first threaded retainer bore 60 and a second threaded retainer bore 61 two threaded retainer bores 60 and 61 for engaging locking screws 63*a* and 63*b*. The quick coupler is showing a having an upper portion 16*a*, a lower portion 16*b*, and a space 73.

Returning to FIG. 3, the quick coupler can have a first quick coupler face 64 adjacent the lower threaded adapter 62. The first quick coupler face 64 can be at about a 60 degree angle from the quick coupler axis 14, but the first quick coupler face 64 can be at an angle from about 40 degrees to about 70 degrees.

A quick coupler lower seal 65 can be formed adjacent the first quick coupler face 64. This seal 65 can be a metal to metal seal.

A second seal area 66 can be adjacent the quick coupler lower seal 65. This second seal area 66 seals with the second inner seal shown in FIG. 1.

The upper threaded area 68 can have a length between about 1 inch to about 3 inches.

The upper threaded area 68 can have left or right handed thread types pending well bore or customer requirements.

The quick coupler lower seal 65 can also have a third sealing surface 70 on its interior. This third sealing surface can be a polished sealing surface that accepts the seals of first inner seal 29.

The exterior of the lower threaded adapter can have a quick coupler locking groove 72. The quick coupler locking groove 72 can be used for securing a seal 71 such as a retainer o-ring of an interlocking composite material.

The quick coupler body 12 can have a quick coupler guide face 78, which can be adjacent to a quick coupler shoulder 80, both of which can be formed on the quick coupler exterior 15.

The quick coupler guide face 78 can have an angle between about 30 degrees to about 70 degrees from the quick coupler axis 14.

The quick coupler tapered outer body guide face 82 can be formed on the quick coupler exterior 15 and provide a tapered exterior for the quick coupler body 12. The quick coupler lower face 84 can be the bottom-most surface of the quick coupler body 12 and adjacent to the end of the tapered quick coupler lower face 82.

Figure 5:
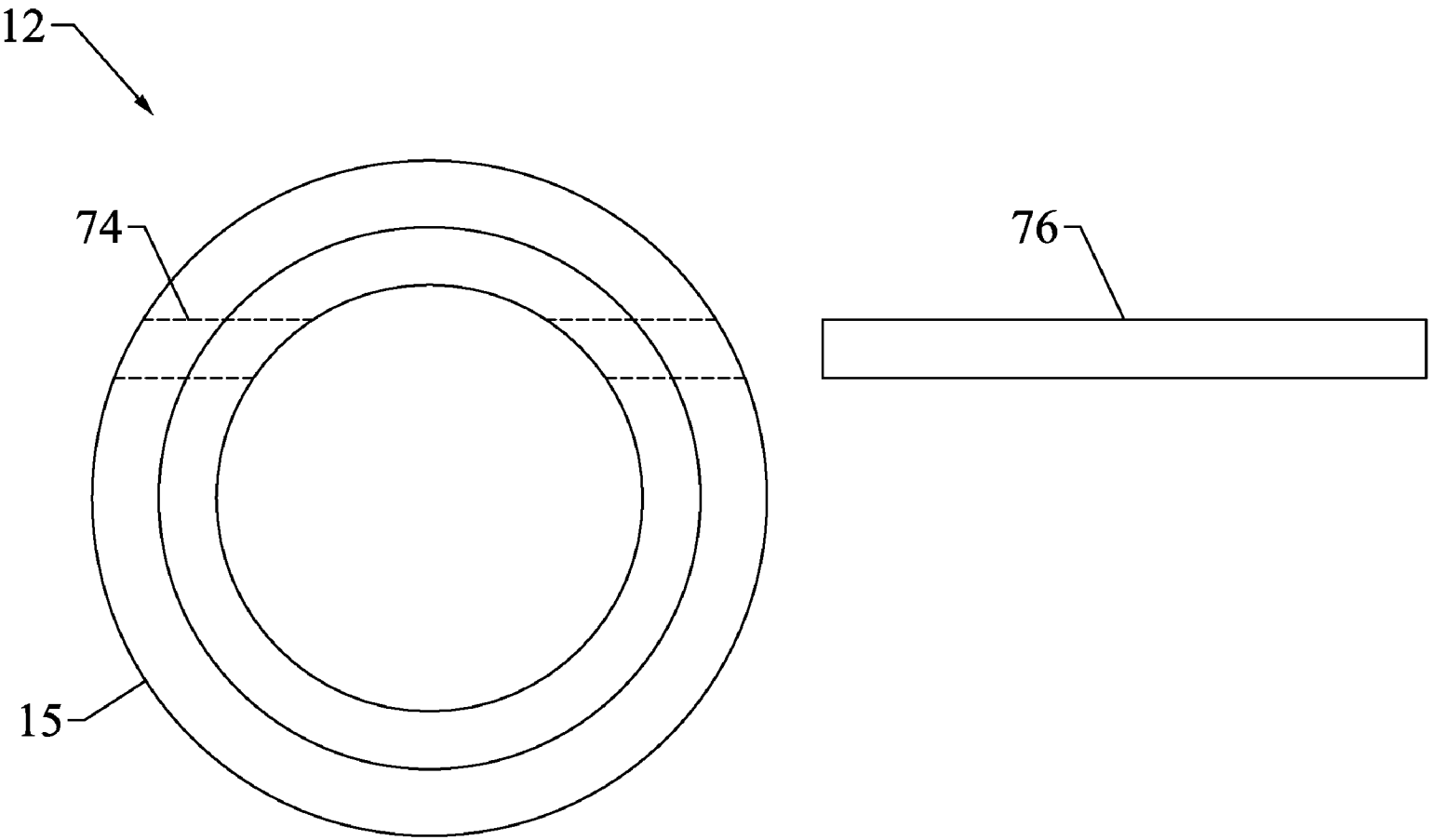
FIG. 5 is a top view of the pin locking mechanism of the invention.

FIG. 5 illustrates a top of the quick coupler body 12 having an exterior 15. A quick coupler retainer bore 74 can be seen in the quick coupler body 12 for retaining a quick coupler retaining pin 76, which is shown external to the quick coupler body. This retainer bore and pin can be identical to the sub body retainer bore and pin.

To use this invention, the threaded packer sub is connected to the quick coupler as described above and inserted into the bore of a well tubular. Drilling mud is then pumped into the threaded packer sub upper end from a fluid vessel or an earth pit. Fluid flows from the upper end of the threaded packer sub through the bore of the sub body the lower end of the threaded packer sub. Fluid then flows into the quick coupler bore and then into the bore of the well tubular.

Figure 6:
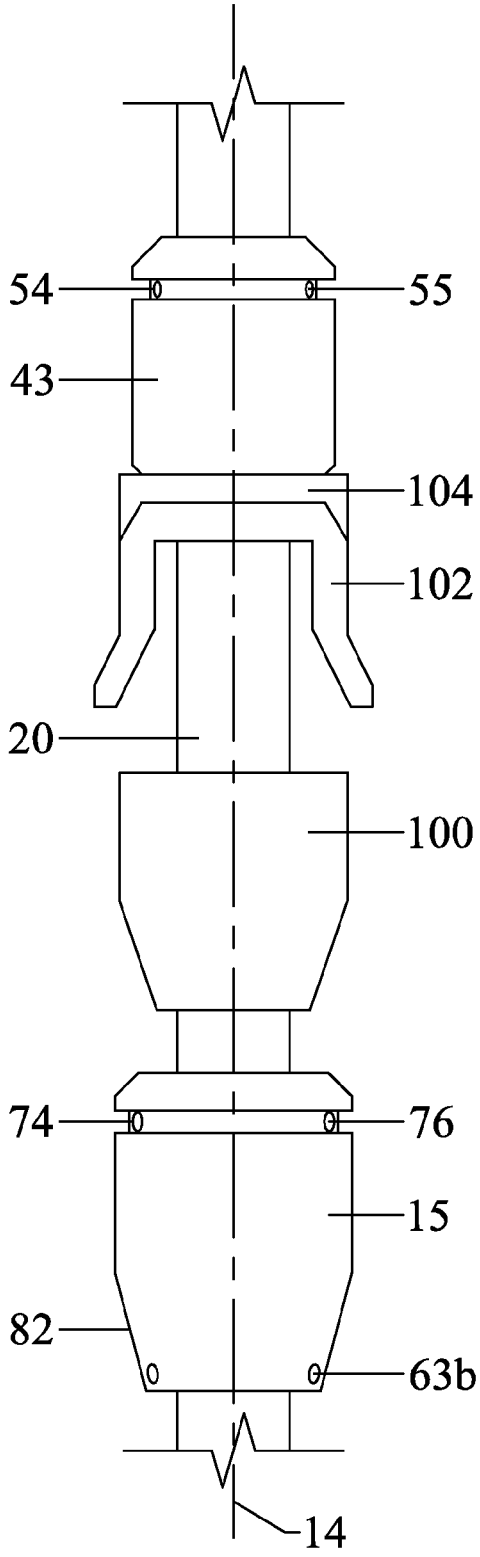
FIG. 6 shows a front view of the assembled device.

FIG. 6 shows a detail of the assembly with the sub body upper end exterior 43 depicted that surrounds the upper end bore 42. The upper locking retainer bore is shown with the upper locking pin 55. A packer cup 102 is depicted adjacent a thimble cup 104. Below the packer cup and thimble cup is a gauge ring 100. The quick coupler is shown with the quick coupler exterior 15 showing the quick coupler beneath the gauge ring and having the quick coupler locking groove 72 and quick coupler retaining pin 76.

The tapered side of the quick coupler tapered outer body guide face 82 is shown which enables ease of insertion into a well bore. A locking screw 63*b* is also depicted along with the quick coupler axis 14.

While these embodiments have been described with emphasis on the embodiments, it should be understood that within the scope of the appended claims, the embodiments might be practiced other than as specifically described herein.

What is claimed is:

1. A circulator sub tool for dispensing and circulating fluid in a well bore comprising:

a. a threaded packer sub comprising:

(i) a sub body with a sub body bore;

(ii) a lower end integral with the sub body, wherein the lower end comprises:

1. a lower end bore; and
2. a lower end exterior on which is disposed a lower end locking groove, a first inner seal, a second inner seal, and an inner shoulder; and (iii) an upper end connected to the lower end comprising:

1. an upper end axis along which an upper end bore is formed;
2. an upper end sub shoulder in communication with a centering guide face;
3. an upper end exterior surrounding the upper end bore;
4. an upper locking groove formed on the upper end exterior, an upper first inner seal area, an upper threaded section, and an upper locking retainer bore disposed through the upper end at an angle between sixty degrees and ninety degrees from the upper end axis, wherein the upper locking retainer bore is adapted for receiving an upper locking pin; and
5. an upper shoulder disposed on the upper end exterior; and b. a quick coupler body for threadably engaging the sub body, wherein the quick coupler body comprises:

(i) a quick coupler bore formed along a quick coupler axis;

(ii) a quick coupler exterior formed around the quick coupler bore;

(iii) a lower threaded adapter formed around the quick coupler bore, wherein the lower threaded adapter has at least a first threaded retainer bore and second threaded retainer bore;

(iv) a first quick coupler face formed adjacent to the lower threaded adapter around the quick coupler bore;

(v) a quick coupler lower seal around the quick coupler bore above the first quick coupler face;

(vi) a second seal area formed around the quick coupler bore;

(vii) an upper threaded area formed around the quick coupler bore;

(viii) a third seal area formed around the quick coupler bore;

(ix) a quick coupler locking groove formed in the quick coupler exterior, wherein the quick coupler locking groove forms a space between an upper portion of the quick coupler exterior and a lower portion of the quick coupler exterior, wherein the quick coupler locking groove has a diameter smaller than a diameter of the quick coupler exterior, and wherein the space is for securing an o-ring or other seal;

(x) a quick coupler retainer bore disposed sixty degrees to ninety degrees from the quick coupler axis within the quick coupler locking groove, wherein the quick coupler retainer bore is adapted for receiving a quick coupler retaining pin;

(xi) a quick coupler guide face formed in the quick coupler exterior; and (xii) a quick coupler shoulder formed in the quick coupler exterior, wherein diameters for each bore of the quick coupler body and the sub body are substantially identical enhancing laminar flow through the threaded packer sub.

2. The circulator sub tool for dispensing and circulating fluid in a well bore of claim 1, wherein the quick coupler has a quick coupler tapered outer body guide face formed in the quick coupler exterior near a quick coupler lower face.

3. The circulator sub tool for dispensing and circulating fluid in a well bore of claim 1, wherein the inner shoulder creates a metal to metal seal on the quick coupler body.

4. The circulator sub tool for dispensing and circulating fluid in a well bore of claim 1, wherein the locking grooves support thermoplastic seals.

5. The circulator sub tool for dispensing and circulating fluid in a well bore of claim 1, wherein the first and second inner seals are o-rings.

6. The circulator sub tool for dispensing and circulating fluid in a well bore of claim 1, wherein the quick coupler body is carbon steel.

7. The circulator sub tool for dispensing and circulating fluid in a well bore of claim 1, wherein a gauge ring is disposed over the sub body and above the quick coupler shoulder.

8. The circulator sub tool for dispensing and circulating fluid in a well bore of claim 7, wherein a packer cup surrounds the sub body proximate to the gauge ring.

9. The circulator sub tool for dispensing and circulating fluid in a well bore of claim 8, wherein a thimble cup surrounds the sub body adjacent the packer cup.

10. A circulator sub tool for dispensing and circulating fluid in a well bore comprising:

a. a threaded packer sub comprising:

(i) a sub body with a sub body bore;

(ii) a lower end integral with the sub body, wherein the lower end comprises:

1. a lower end bore; and
2. a lower end exterior with a lower end groove, a first inner seal, a second inner seal, and an inner shoulder; and (iii) an upper end connected to the lower end comprising:

1. an upper end axis along which an upper end bore is formed;
2. an upper end sub shoulder connected to a centering guide face;
3. an upper end exterior surrounding the upper end bore;
4. an upper groove formed on the upper end exterior, an upper first inner seal area, an upper threaded section, and an upper bore disposed through the upper end at an angle between sixty degrees and ninety degrees from the upper end axis, wherein the upper bore is adapted for receiving an upper pin; and
5. an upper shoulder disposed on the upper end exterior; and b. a quick coupler body for threadably engaging the sub body, wherein the quick coupler body comprises:

(i) a quick coupler bore formed along a quick coupler axis;

(ii) a quick coupler exterior formed around the quick coupler bore;

(iii) a lower threaded adapter formed around the quick coupler bore, wherein the lower threaded adapter has at least one threaded bore;

(iv) a first quick coupler face formed adjacent to the lower threaded adapter around the quick coupler bore;

(v) a quick coupler lower seal around the quick coupler bore above the first quick coupler face;

(vi) a second seal area formed around the quick coupler bore;

(vii) an upper threaded area formed around the quick coupler bore;

(viii) a third seal area formed around the quick coupler bore;

(ix) a quick coupler groove formed in the quick coupler exterior, wherein the quick coupler groove forms a space between an upper portion of the quick coupler exterior and a lower portion of the quick coupler exterior, wherein the quick coupler groove has a diameter smaller than a diameter of the quick coupler exterior, and wherein the space is for securing an o-ring or other seal;

(x) a quick coupler bore disposed sixty degrees to ninety degrees from the quick coupler axis within the quick coupler locking groove, wherein the quick coupler retainer bore is adapted for receiving a quick coupler pin;

(xi) a quick coupler guide face formed in the quick coupler exterior; and (xii) a quick coupler shoulder formed in the quick coupler exterior, wherein diameters for each bore of the quick coupler body and the sub body are substantially identical enhancing laminar flow through the threaded packer sub.

11. The circulator sub tool for dispensing and circulating fluid in a well bore of claim 10, wherein the quick coupler has a quick coupler tapered outer body guide face formed in the quick coupler exterior near a quick coupler lower face.

12. The circulator sub tool for dispensing and circulating fluid in a well bore of claim 10, wherein the inner shoulder creates a metal to metal seal on the quick coupler body.

13. The circulator sub tool for dispensing and circulating fluid in a well bore of claim 10, wherein the grooves support thermoplastic seals.

14. The circulator sub tool for dispensing and circulating fluid in a well bore of claim 10, wherein the first inner seal and the second inner seal are o-rings.

15. The circulator sub tool for dispensing and circulating fluid in a well bore of claim 10, wherein the quick coupler body is carbon steel.

16. The circulator sub tool for dispensing and circulating fluid in a well bore of claim 10, wherein a gauge ring is disposed over the sub body and above the quick coupler.

17. The circulator sub tool for dispensing and circulating fluid in a well bore of claim 16, wherein a packer cup surrounds the sub body proximate to the gauge ring.

18. The circulator sub tool for dispensing and circulating fluid in a well bore of claim 17, wherein a thimble cup surrounds the sub body adjacent the packer cup.

* * * * *